United States Patent [19]

Fehrle et al.

[11] Patent Number: 4,567,951

[45] Date of Patent: Feb. 4, 1986

[54] HAMMER DRILL

[75] Inventors: Siegfried Fehrle; Gerhard Meixner; Karl Wanner, all of Leinfelden-Echterdingen, Fed. Rep. of Germany

[73] Assignee: Robert Bosch GmbH, Stuttgart, Fed. Rep. of Germany

[21] Appl. No.: 560,425

[22] Filed: Dec. 12, 1983

[30] Foreign Application Priority Data

Feb. 12, 1983 [DE] Fed. Rep. of Germany ..... 3304916

[51] Int. Cl.[4] ..... B25D 9/00

[52] U.S. Cl. ..... 173/116; 173/117; 173/123

[58] Field of Search ..... 173/139, 117, 123, 116, 173/118

[56] References Cited

U.S. PATENT DOCUMENTS

| | | | |
|---|---|---|---|
| 3,114,421 | 12/1963 | McCloud | 173/139 |
| 3,720,269 | 3/1973 | Wanner et al. | 173/123 |
| 4,310,055 | 1/1982 | Wanner et al. | 173/139 |
| 4,456,076 | 6/1984 | Schmid et al. | 173/123 |

*Primary Examiner*—James M. Meister
*Assistant Examiner*—John L. Knoble
*Attorney, Agent, or Firm*—Michael J. Striker

[57] ABSTRACT

In a drill hammer a motor driven striking mechanism is provided with two air cushions of changeable volumes, through which impact energy is transmitted from the motor to a reciprocating striker which in turn transmits the energy to a tool of the drill hammer. When the striker moves in the direction towards the tool both air cushions act on the striker whereas when the striker moves away from the tool only one of two air cushions acts on the striker.

14 Claims, 11 Drawing Figures

FIG.10
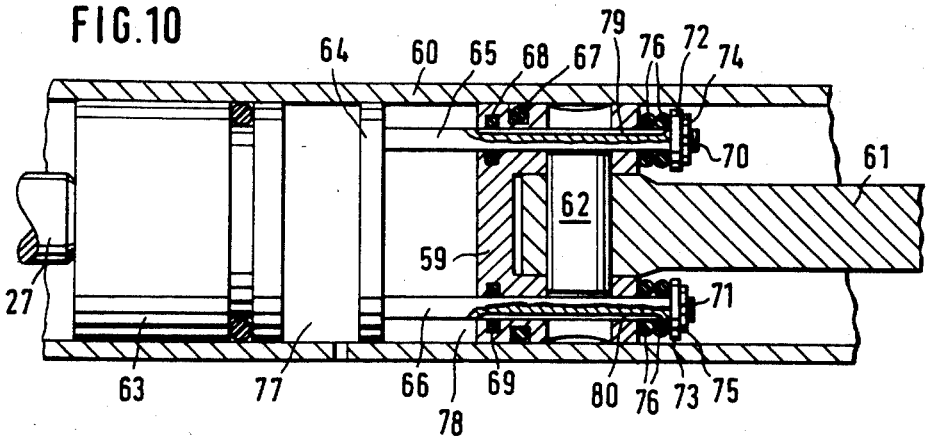
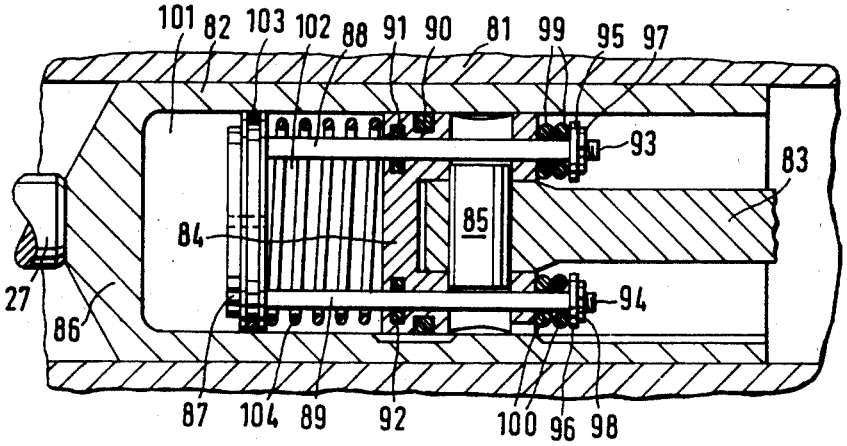
FIG.11

HAMMER DRILL

BACKGROUND OF THE INVENTION

The present invention relates to a hammer drill or percussion hammer.

Such hammer drills have been known in the art. One of such hammer drills, is an impact wrench which has been disclosed in U.S. Pat. No. 3,874,460. In this known impact tool an impact energy of the striker is transmitted to the tool; the striker is reciprocally displaced in the inner space of the cylinder by the hollow piston, which serves as an actuating member, by means of the drive motor, so that during the operation an air cushion formed between the bottom of the hollow piston and the striker acts on the striker and when the tool is inoperative an underpressure air cushion formed between the bottom of the hollow piston and the striker acts on the striker in the opposite direction.

In the impact tool disclosed in GB-PS No. 16 00 944, impact energy is transmitted to the tool by a striker which is slidingly guided in the cylindrical inner space of the guide tube; the striker is axially reciprocally displaced by the drive motor via the piston which serves as an actuating member. During the operation the striker is taken along by a closed air cushion and in the inoperative position an underpressure cushion, which is formed between the piston and the striker, urges the striker in the opposite direction.

British specification GB-PS No. 14 67 215 discloses a striking mechanism with a guide cylinder in which a hollow cylinder having a transverse wall and a piston therein is guided so that the hollow cylinder forms a striker, the piston of this hollow cylinder being reciprocally driven from a motor via a crank transmission. A periodically open or closed to the atmosphere air chamber is formed between the transverse wall of the hollow cylinder and the front wall of the piston; the air filling that air chamber acts as a spring and transmits a drive load to the striker and, after the impact, during the reverse stroke of the reciprocal piston the striker is pulled back under the underpressure.

In these known striking mechanisms only one air chamber is provided between the reciprocating actuating member and the striker. In this case a relatively high pressure or underpressure should be produced in the air chamber in order to provide a normal operation of the striking mechanism in the direction of the transmitting impact energy to the tool and in the reverse direction as well. This, however, causes strong vibrations of the whole power tool during the operation, which leads to very undesired oscillating loads on the operator.

Applicant's U.S. Pat. Nos. 4,310,055 and 4,336,848 also disclose hand-held impact tools in which one air cushion is utilized in the striking mechanism.

SUMMARY OF THE INVENTION

It is an object of the invention to provide an improved hammer drill.

It is another object of the present invention to provide a power tool in which, vibrations, normally generated during the operation of the tool of this type, would be substantially reduced and at the same time the operation output of the striker would be increased because larger impact masses would be possible with the air cushion of the diameter equal to that of conventional power tools.

These and other objects of the invention are attained by a hammer drill, comprising a tool, and a motor-driven striking mechanism including an axially reciprocable actuating member driven by the motor, and a striker actuated by said actuating member via an air cushion for movements towards and backwards from said tool to transmit impact energy to said tool; the air cushion being comprised of two partial air cushions which are positioned one after another, said partial air cushions being formed by two air chambers having changeable volumes, said striking mechanism being operative so that during the backwards movement of said striker only one of said partial air cushions acts on said striker and during the movement of the striker towards said tool both air cushions act on said striker.

Due to the provision in the striking mechanism of two air cushions formed in two air chambers and limiting each other a releatively short underpressure air cushion is produced for a returning suction or return stroke of the striker and a relatively long air cushion is provided for the operating stroke of the striker, which requires compression. Owing to the greater length of the air cushion a pressure of the air cushion, required during the compression stage, is substantially smaller than that of the conventional hammer drills of the type under discussion. The advantage of the hammer drill with two air cushions according to the invention is that percussion loads are reduced. All the component parts of the drill, such as electrical parts, gears and others are therefore less loaded whereby a lighter and less expensive construction of the drill is possible. Furthermore, oscillation loads on the operator are significantly reduced.

According to a further aspect of the invention the actuating member may be a hollow piston having a cylindrical inner space, in which said striker is guided, and a bottom, the striking mechanism further including an intermediate piston movable in the direction of axis of the reciprocable hollow piston said two air chambers being formed in said cylindrical space of the hollow piston between said striker and said bottom and being separated from each other by said intermediate piston.

According to still another concept of the invention the striking mechanism may further include a guide sleeve having a cylindrical inner space and a piston slidingly movable therein and forming said actuating member, said piston having a bottom; and an intermediate piston movable in the direction of axis of said piston, said two air chambers being formed in said cylindrical space of said guide sleeve between said piston and said striker and being separated from each other by said intermediate piston.

In accordance with yet another concept of the invention the striking mechanism may further include a guide cylinder and a hollow cylinder having a transverse wall and a piston having a front face and a bottom and longitudinally guided in said hollow cylinder, said hollow cylinder forming said striker, a crank transmission for driving said piston towards and backwards from said tool and wherein a main air chamber is formed between said transverse wall of the hollow cylinder and the front face of said piston, said air chamber being periodically open or closed from the atmosphere and when filled with air operating as a spring acting on the striker to transmit impact energy thereto and wherein said striker during a return stroke of said piston is pulled backwards under underpressure in said main air chamber, said striking mechanism further including an intermediate piston, movable in the direction of axis of said first mentioned piston, said main air chamber being subdivided into the aforementioned two air chambers by said intermediate piston.

Therefore, in each type of the striking mechanism two air cushions are formed separated from each other by the intermediate piston.

The bottom of the main piston in each type of the striking mechanism may be formed with at least one bore, the piston rod of the intermediate piston being positioned and slidingly guided in said bore.

The bottom of the main piston may be formed with a recess radially extending from said bore, said recess receiving a sealing O-ring.

The piston rod of the intermediate piston may have a longitudinal ventilation groove extended via a portion of the entire length of the piston rod.

The striking mechanism may include a damping means, such as a rubber ring, inserted between a limiting stop for limiting the movement of the intermediate piston and the main piston.

The striking mechanism may further include a compression spring arranged between said first mentioned piston and said intermediate piston, said spring tending to constantly maintain said intermediate piston in such a position relative to said first mentioned piston that said limiting stop is in an end position relative to said first mentioned main piston.

In accordance with yet another modification of the invention the striking mechanism may further include a hollow piston having a bottom and a cylindrical inner space in which said striker is guided, and an elastic, air-filled spring means positioned in said inner space between said bottom and said striker said two air chambers being formed in said cylindrical inner space, said spring means dividing said inner space into said two air chambers.

The elastic, air-filled spring means may include a hollow body enclosing one of said two air chambers. The hollow body may be a ball made of rubber.

The striking mechanism, in which two air chambers forming two air cushions are constituted by the elastic air-filled spring-like hollow body, has the advantage that, due to the provision of a respective air volume ratio of air, contained in the hollow body or rubber ball, to the air outside the hollow body important characteristics of the striking mechanism can be influenced. Furthermore, an impact of the striker against the body of the piston is prevented in the case of an eventually defective sealing within the striking mechanism.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 10 is a partial sectional view of the striking mechanism of a further embodiment of the invention; and FIG. 11 is a partial sectional view of the striking mechanism according to a still another embodiment of the invention.

DETAILED DESCRIPTION OF THE PREFERRED EMBODIMENTS

Figure 1:
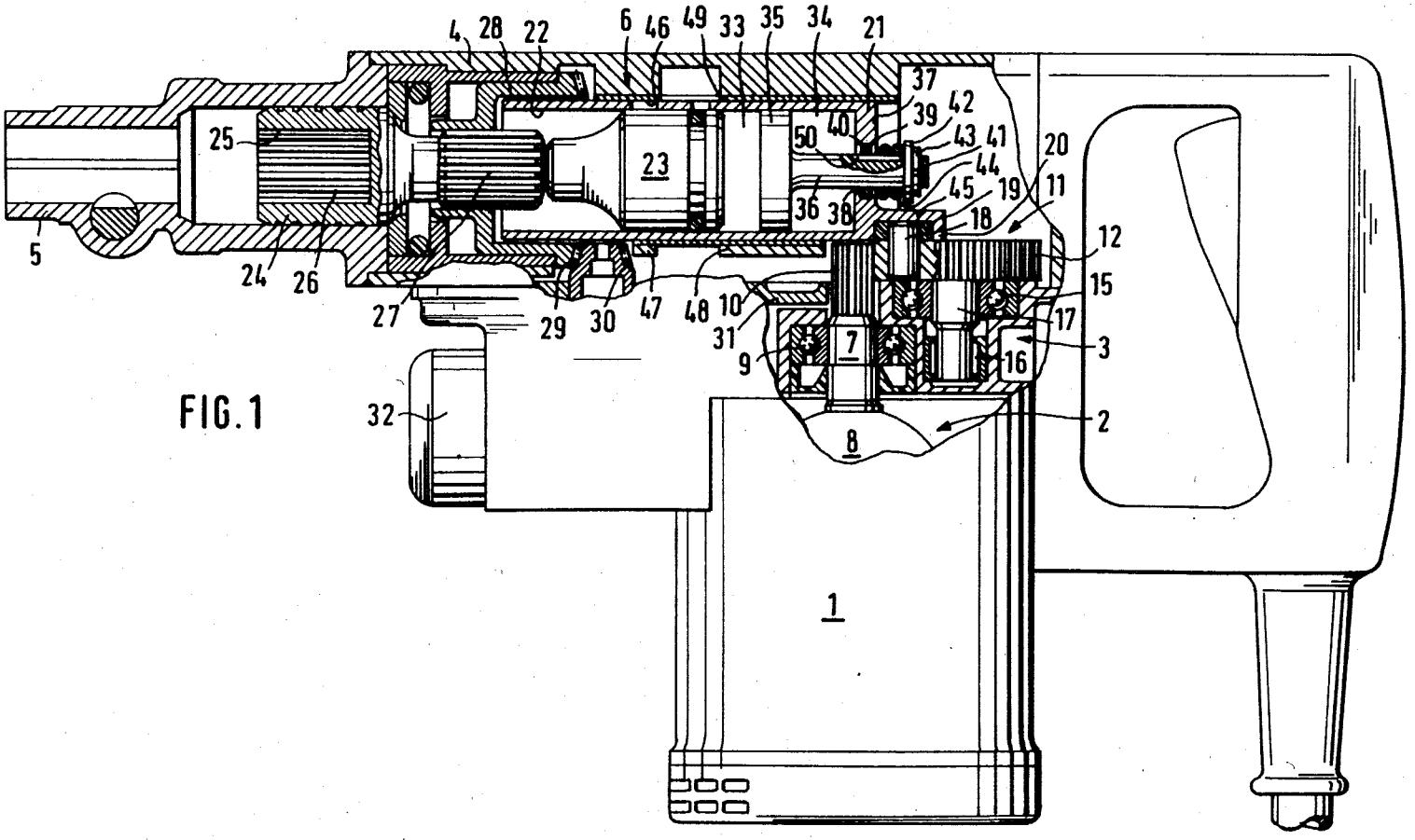
FIG. 1 is a side, partially sectional view of the hammer drill according to the invention.

Referring now to the drawings, and first to FIG. 1, the hammer drill includes a housing which is formed of two main portions. The first housing portion, which is designated by reference character 1, accommodates an electric drive motor 2 partially shown in the drawing and a transmission denoted by reference numeral 3. The second housing portion 4, which is disposed above housing portion 1, accommodates a tool holder 5 and a striking mechanism 6. The first housing portion 1 is in turn comprised of a prefabricated metal casing, which receives therein transmission 3, and another casing made out of synthetic plastic material and formed, for example by injection molding, the plastic casing accommodating electric motor 2. The housing portion 4 can be made of metal as shown in the exemplified embodiment, but can be also formed of synthetic plastic material.

The hammer drill is provided in the known fashion, at the side thereof facing away from tool holder 5, with a grip whereby the drill can be utilized as a hand-held power tool. A conventional and therefore not shown pressure switch, which controls electric drive motor 2, is located within the grip.

Electric drive motor 2 has an armature 8 mounted on a motor shaft 7. The latter is received in two opposite bearings, of which only the upper ball bearing 9 is seen in FIG. 1. Motor shaft 7 carries at the end thereof projecting outwardly from ball bearing 9, a motor pinion 10 which is arranged approximately in a middle plane with respect to the elongation of the drill housing. The motor pinion 10 meshes with a toothed rim 12 formed on the periphery of a crank disc 11. Crank disc 11 is situated on a shaft 17 which is arranged in the metal casing portion of the housing by means of a ball bearing 15 and a needle bearing 16.

The crank disc 11 carries a crank pin 18 excentrically mounted thereto. A sliding block 19 is rotationally but immovably in the axial direction arranged on crank pin 18. The sliding block 19, which has the shape of parallelipiped, is engaged in a straightly projecting sliding guide 20 of the striking mechanism 6.

The striking mechanism 6 has a cup-like hollow drive piston 21, in the cylindrical bore 22 of which a striker 23 is sealingly and slidingly guided. The striker 23 acts on a tool head 24 which is formed as an intermediate anvil and is axially displaceable and rotatable in the sleeve-like tool holder 5. Striker 23 transmits impact energy to the tool head 24 in the known manner.

The tool head 24 has a receiving pocket-like hole 25, the surface forming hole 25 constituting a spline-like torque-transmitting means 26 into which a corresponding end of the tool not illustrated herein is to be inserted. The tool head 24 has, at the side thereof facing away from hole 25, a cylindrical projection 27 formed with an outer spline. The latter is engaged in an inner spline of a hollow bevel gear 28 formed at the projected cylindrical widened portion thereof, formed with a bevel gearing 29. The end of drive piston 21 overlaps that widened portion of bevel gear 28. Bevel gearing 29 of gear 28 meshes with a bevel pinion 30, which is disposed in the metal portion of the housing. Only a part of bevel pinion 30 is shown in FIG. 1. A gear 31, partially shown in the drawing, is a part of a transmission gearing between the motor pinion 10 and bevel pinion 30. The gear 31 is operatively connected, via a coupling (not shown in the drawing) actuated by a rotation knob 32, to the bevel pinion 30. This arrangement forms a rotation drive of the hammer drill.

As shown in FIG. 1 two air chambers 33 and 34, separated from each other by an intermediate piston 35, are formed in bore 22 of the hollow drive piston 21 at the side of striker 23, facing away from the tool head 24. The intermediate piston 35 has a piston rod 36 which extends through a bore 38 provided in a plate-like bottom wall 37 of hollow piston 21. A circular recess or groove 39 extends radially from bore 38. A seal, preferably an O-ring 40, is inserted in groove 39. The piston rod 36 has at the end thereof extended outwardly from plate-like bottom 37 a threaded projection 41. A ring-shaped stop washer 42 is mounted on the threaded projection 41 and is rigidly secured thereon by means of a nut 43. A damping means for damping axial impacts of the striker against the tool head 24 is inserted between circular washer 42 and bottom 37 of drive piston 21. Rubber rings 44 form that damping means.

During the operation of the hammer drill the hollow piston 21, driven by the above described crank slide transmission formed by the slide guide 20 and crank pin 18 of gear 11, forms a drive for striker 23. Therefore hollow piston 21 has, on the side thereof, facing away from striker 23, a projection 45 integral with piston 21, which projection forms the slide guide 20.

The hollow piston 21, which constitutes the striking mechanism 6, is guided in a guide 46 formed in the housing portion 4 of the drill. In the embodiment shown in FIG. 1 guide 46 for the hollow piston 21 is formed by two coaxially and one after another positioned guide bars 47 and 48. In order to reduce friction losses during the guiding of the hollow piston 21 within the housing of the hammer drill a sleeve 49 made of a material having good bearing properties, such as brass or any other suitable bearing material, is placed in guide 46. During the assembly the hollow piston 21 is merely slidably inserted into guide 46 from the side of the tool holder 5.

The piston rod 36 has a ventilation groove 50 which extends lengthwise of the rod over a portion of its entire length, so that after the positioning of the intermediate piston 35 into the hollow piston 21, an air chamber 34 is either sealed from the atmosphere or connected thereto.

The mode of operation of the hammer drill with the striking mechanism according to FIG. 1 will be explained with reference to FIGS. 2 to 5.

Figure 2:
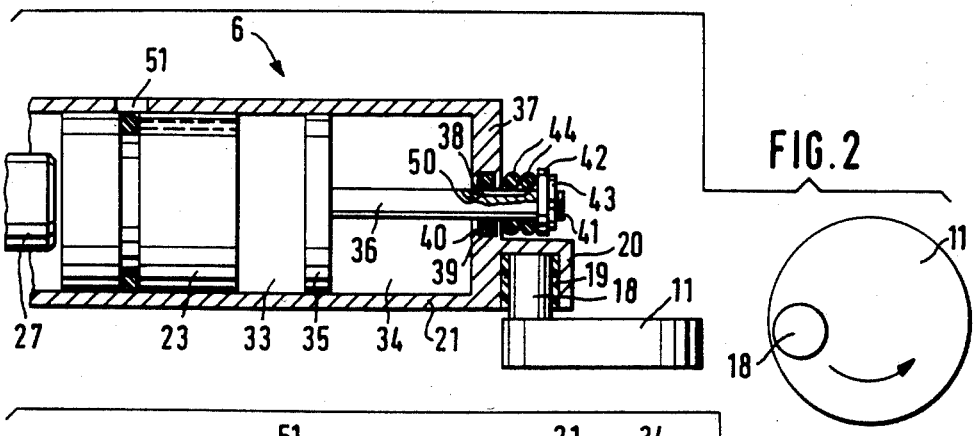
FIGS. 2 through 5 schematically illustrate the striking mechanism of FIG. 1 in various operative positions.
Figure 3:
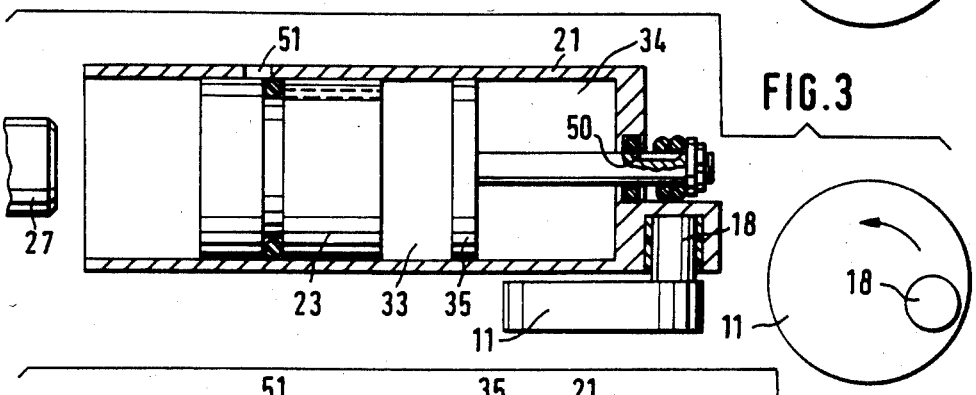
Figure 4:
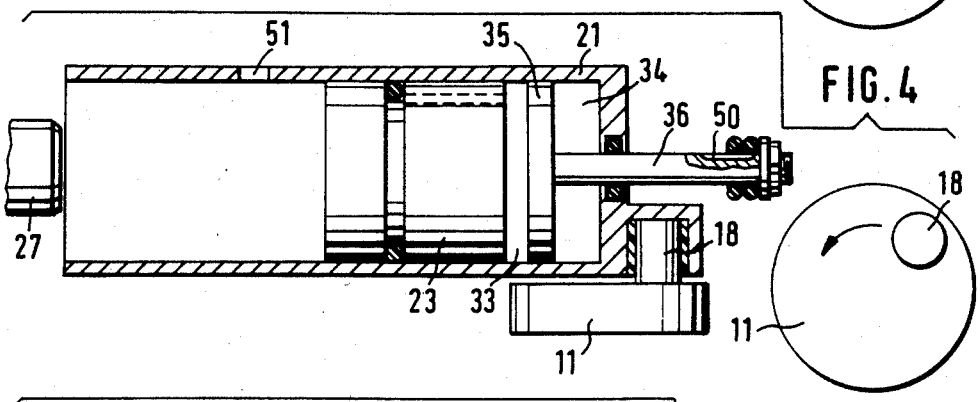
Figure 5:
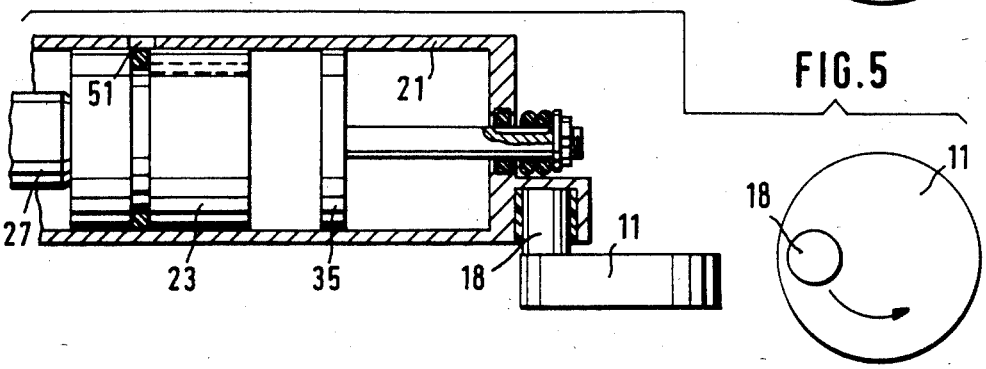

If electric motor 2 is switched on it actuates the crank disc 11 which is rotated, causing a respective rotation of circular pin 18 about the axis of disc 11 whereby the slide block 19 and thus slide guide 20 will move hollow piston 21 back and forth. FIG. 2 shows the position, which the individual components of the striking mechanism take after the striker 23 has transmitted its impact energy to the tool; crank disc 11 is rotated in the ditection of the arrow. The crank pink 18 moves hollow piston 21 in the above described manner to the position illustrated in FIG. 3. The intermediate piston 35 is taken along by hollow piston 21 via rubber rings 44, ring-like washer 42 and piston rod 36. This motion results in that a short air cushion in air chamber 33, which is located between the striker 23 and intermediate piston 35, is formed which is an underpressure air cushion, which will suck in and draw the striker. The latter thus moves towards the bottom wall 37 of hollow piston 21 and closes the ventilation bore 51 provided in hollow piston 21. The air cushion closed in air chamber 33 is again compressed and displaces the intermediate piston 35. Thereby the ventilation groove or recess 50 in piston rod 36 is moved to such a position that the connection between the air chamber 34 and the atmosphere is interrupted. The smooth outer surface of the piston rod 36 in connection with O-ring 40 closes the air chamber from the outside of the piston in an air-tight fashion. The air cushions disposed in the air chambers 33 and 34 are further compressed until the striking mechanism is in the position shown in FIG. 4, in which position the both air cushions reach their minimal lengths. Thereby, the movement of striker 23 in the forward direction is effected, which takes place under the influence of the air cushions in both air chambers 33 and 34. In the position of FIG. 5, striker 23 reaches the face of the cylindrical projection 27 of the tool head 24, which serves as the intermediate anvil, and transmits the impact energy to the tool head 24. Intermediate piston 35, which is also eventually moved forwardly, is supported by a damping assembly composed of elements 37, 42 and 44. In order to compensate for eventual leakage losses in the system, both air cushions are again vented via venting openings 50 and 51 in the known fashion.

The construction and the mode of operation of the striking mechanism according to the invention clearly show that the return feeding or suction of the striker 23 takes place due to the extremely short air cushion and therefore in the extremely efficient manner whereas a relative longer air cushion, which is required for the compression step, is formed by two combined air cushions formed in both air chambers 33 and 34.

Reference is now made to FIGS. 6 through 9, illustrating a modified embodiment of the invention. It should be noted that for the sake of clarity only those components of the hammer drill, which are different from those of FIG. 1, are shown in FIGS. 6 to 9. The hollow piston, which is here designated by a reference character 52 is at one side thereof facing away from projection 27 of the tool head 24, is completely closed. The hollow piston 52 is displaced back and forth by means of crank disc 11 and crank pin 18 in the above described manner when electric drive motor 2 is switched to the operative position. The closed bottom wall of piston 52 is semicircular. A ball 56 made out of rubber is located within piston 52. Striker 55 is slidingly and sealingly arranged within hollow piston 52. A first air chamber 57 is formed between striker 57 and rubber ball 56 whereas a second air chamber 58 is formed in the interior of rubber ball 56.

Figure 6:
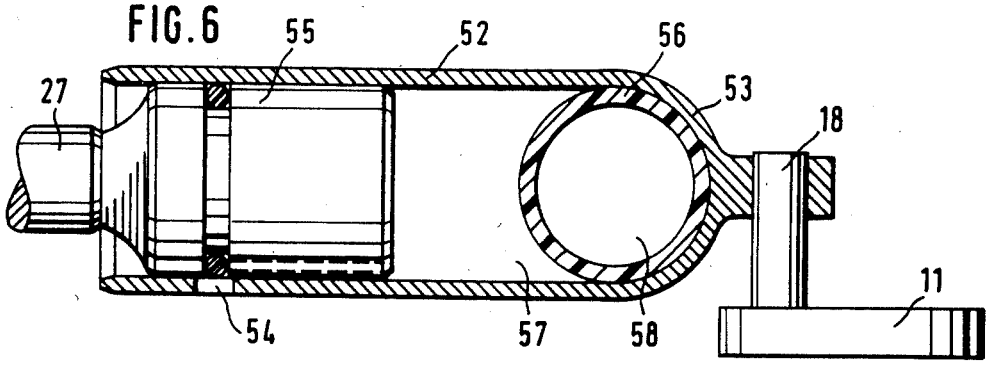
FIGS. 6 through 9 schematically illustrate, in the sectional views, various operative positions of the hammer drill according to another embodiment of the invention.
Figure 7:
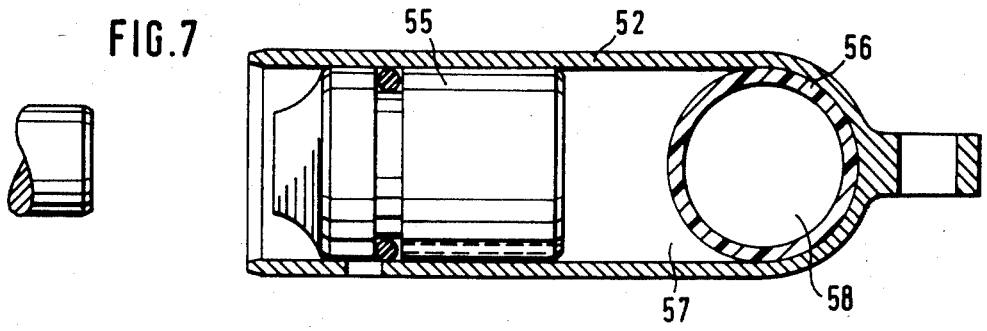
Figure 8:
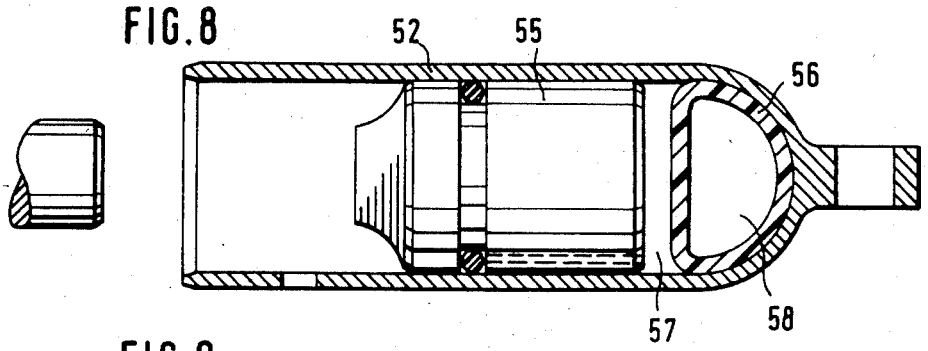
Figure 9:
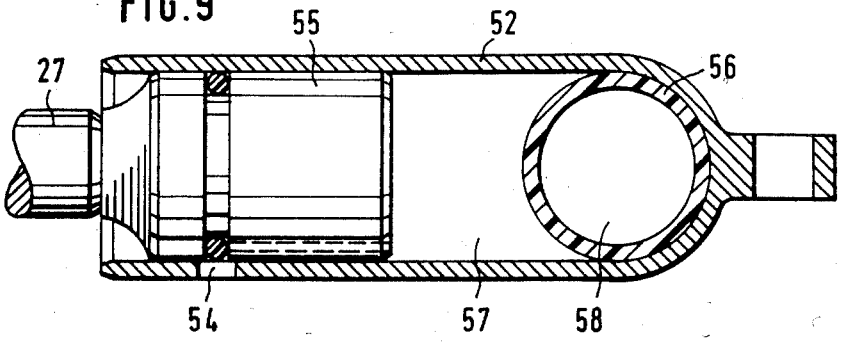

In operation, the hollow piston 52 is moved, due to the rotation of crank disc 11 from drive motor 2 from the position shown in FIG. 6 to the position ellustrated in FIG. 7. An underpressure air cushion is formed in air chamber 57 whereby striker 55 is moved away from the cylindrical projection 27 of tool head 24. FIG. 7 shows the position of the components of the striking mechanism shortly before the crank 11, 18 has reached its rear dead center. The further movement of striker 55 causes a compression of the entire air cushion formed by both air cushions located in air chambers 57 and 58. In the position shown in FIG. 8 the striker is in its rearmost position, in which a maximal compression is attained. The rubber ball 56 is then compressed and deformed as schematically shown in FIG. 8. Then the air cushions disposed in air chambers 57 and 58 operate together as air springs whereby a greater residual air-spring length will be obtained. The air pressure itself, therefore, remains relatively small. Striker 55 is accelerated in the direction of the tool and strikes against the cylindrical projection 27 to which the striker transmits the impact energy (FIG. 9). The rubber ball 56, which has been previously deformed by compression, is released and again takes its normal shape. The air cushion elastic volume within air chamber 57 is thus reduced so that an easy returning feed or suction of the striker 55 for a following percussion cycle can take place. In order to compensate for eventual leakage losses within air chamber 57 a ventilation bore 54 is newly vented in the known manner.

The striking mechanism of the embodiment shown in FIG. 10 has a hollow cylinder 60 open at both sides thereof, in which a piston 59 is reciprocally moved. A piston pin 62 connects piston rod 61 with piston 69 in the known fashion. Striker 63 is taken along by an air cushion formed due to the reciprocal movement of piston 59, whereby striker 63, when strikes against the face of projection 27, transmits the impact energy to the cylindrical projection 27 of tool head 24. An intermediate piston 64 is provided in cylinder 60 between piston 59 and striker 63; piston 64 has two parallel piston rods 65 and 66 displaceable relative to and in the piston 59. In order to provide a sealing connection between piston 59 and cylinder 60 as well as between piston 59 and piston rods 65, 66, O-rings 67, 68 and 69 are arranged between the surfaces which are to be sealed from each other. Piston rods 65, 66 each has a respective threaded projection 70, 71 at the end thereof extended outwardly from piston 59. Ring-like washers 72, 73 operating as limiting stops for the piston rods, are mounted on respective projections 70, 71 and rigidly held on those projections by ring-shaped nuts 74, 75. Damping means, namely rubber rings 76, in the fashion similar to that of the embodiment of FIG. 1, are disposed between washers 72, 73 and the bottom wall of piston 59.

Intermediate piston 64 subdivides the inner space of cylinder 60 between piston 59 and striker 63 into two air chambers 77 and 78. Ventilation grooves 79, 80, which respectively extend along the portions of the entire length of piston rods 65, 66, establish a connection of air chamber 78 with the atmosphere in one predetermined position of intermediate piston 64 relative to piston 59, and seal chamber 78 from the atmosphere in another position of intermediate piston 64 relative to piston 59.

FIG. 10 illustrates the position of the components of the striking mechanism when striker 63 strikes against the face of projection 27. Piston 59 is drawn from the illustrated position rearwardly by the piston rod 61 connected to the non-illustrated motor drive of the hammer drill. The intermediate piston 64 is taken along by piston rods 65, 66 so that piston 64 also participates in this movement. An underpressure air cushion of a relatively small air volume is formed in air chamber 77 whereby striker 63 is speedily sucked off. After the reverse movement of piston 59 caused by piston rod 61, piston 59 moves in the direction towards striker 63. The latter is at this point in its rearmost position in cylinder 60. Air cushions formed in air chambers 77 and 78 are compressed whereby a relatively longer air cushion, as compared to that formed during the suction stage, acts on the striker 63 and accelerates the striker in the direction of the tool. The intermediate piston 64, during the compression stage of the operation, moves against the pressure of the air cushion formed in air chamber 78 in the direction towards piston 59. Thereby ventilation grooves 79, 80 move away from the regions of O-rings 68, 69, so that air chamber 78 is air-tightly closed from the atmosphere. When striker 23 strikes against the face of cylindrical projection 27 all the components of the striking mechanism are in the position of FIG. 10. Rubber rings 76 serve to damp the impact on ring-like washers 72, 73 when they reach the end position.

In the embodiment of FIG. 11 the invention is illustrated in conjunction with a known so-called cup-shaped striker-striking mechanism. This striking mechanism has a guide cylinder 81 in which an axially movable striker 82 is arranged, which is formed as a hollow cylinder closed at one side thereof. A piston 84, driven by the crank via its piston rod 83, is guided in the hollow striker 82. Piston rod 83 and piston 84 are connected to each other by a piston pin 85. An intermediate piston 87 is provided between the bottom 86 of cup-shaped striker 82 and piston 84. Piston 87 has two piston rods 88, 89 displaceable relative to and in piston 84. O-rings 90, 91, 92 are provided for sealing connections between piston 84 and the inner wall of striker 82 and also between piston rods 88, 89 and piston 84, respectively. Piston rods 88, 89 have, at the ends thereof outwardly extending from piston 84, respective threaded projections 93 and 94 which carry ring-like washers 95, 96 rigidly held by nuts 97, 98. Damping means, for example rubber rings 99, 100 are positioned between the washers 95, 96 and the bottom wall of piston 84.

The intermediate piston 87 subdivides the inner space of the cup-shaped striker 82, between bottom 86 and piston 84, into two air chambers 101 and 102. An O-ring 103 provided on the intermediate piston 87 reliably seals the air chamber 101 from air chamber 102. A compression spring 104 disposed between intermediate piston 87 and piston 84 is provided to hold intermediate piston 87 in the strike position as shown in FIG. 11.

FIG. 11 illustrates the position of the components of the striking mechanism when the striker 82 strikes against projection 27 of tool head 24. Starting from this position, piston 84 is pulled backwardly by means of non-illustrated motor drive of the drill via the piston rod 83. The intermediate piston 87 is taken along through piston rods 88, 89 and participates in this movement. An underpressure air cushion of a relatively small volume, is formed in air chamber 101 so that striker 82 is sucked off. After the backward movement of piston 84 caused by piston rod 83, piston 84 moves in the direction of bottom 86 of the striker 82. The latter at this point in in its rearmost position in the guide cylinder 81. The air cushions formed in air chambers 101 and 102 are compressed whereby a relatively longer air cushion, as compared to that formed in the suction stage acts on the striker 82 and accelerates the latter in the direction of the tool. The intermediate piston 87 moves during the compression stage against the pressure of the air cushion formed in the air chamber 102 and the force of compression spring 104 in the direction towards piston 84. When the striker 82 is in the position of striking against the projection 27 all the components of the striking mechanism are again in the position shown in FIG. 11. Rubber rings 99, 100 serve to damp an impact of washers 95, 96 against the bottom wall of piston 84 when the washers are in the end position.

The spring provided in the embodiment of FIG. 11 and positioned between piston 84 and intermediate piston 87 can be also used in the embodiments according to FIGS. 1 to 6 and 10. The effect of such an arrangement is that in the inoperative position of the striking mechanism there will be no relative movement of respective intermediate pistons 35 or 64 relative to pistons 21 or 59.

Seal ring 103 in the intermediate piston 87, provided in the embodiment according to FIG. 11, can be also used in the embodiments of FIGS. 1 through 6 and 10. Due to the utilization of the sealing ring on the intermediate piston a returning feed or suction of the striker is further improved.

It will be understood that each of the elements described above, or two or more together, may also find a useful application in other types of hammer drills differing from the types described above.

While the invention has been illustrated and described as embodied in a hammer drill, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a hammer drill comprising a tool, and a motor-driven striking mechanism including an axially reciprocable actuating member driven by the motor, said actuating member being a main piston having an axis, and a striker actuated by said actuating member via an air cushion for movements towards and backwards from said tool to transmit impact energy to said tool, the improvement comprising the air cushion composed of two partial air cushions which are formed by two air chambers positioned one after another in the direction of movement of said striker and having changeable volumes, said striking mechanism further including an intermediate piston movable in the direction of the axis of said main piston, and wall means, said intermediate piston having at least one piston rod, said wall means being formed with at least one bore, said piston rod being positioned and slidingly guided in said bore, said striking mechanism being operative so that during the backwards movement of said striker only one of said partial air cushions acts on said striker and during the movement of the striker towards said tool both air cushions act on said striker.

2. The hammer drill as defined in claim 1, wherein said main piston is hollow and has a cylindrical inner space, in which said striker is guided, and a bottom which forms said wall means, said two air chambers being formed in said cylindrical space of the main piston between said striker and said bottom and being separated from each other by said intermediate piston.

3. The hammer drill as defined in claim 1, said striking mechanism further including a guide sleeve having a cylindrical inner space, said main piston being slidingly movable in said inner space, said main piston having a bottom which forms said wall means; said two air chambers being formed in said cylindrical space of said guide sleeve between said main piston and said striker and being separated from each other by said intermediate piston.

4. The hammer drill as defined in claim 1, said striking mechanism further including a guide cylinder and a hollow cylinder positioned therein and having a transverse wall, said main piston having a front face and a bottom which forms said wall means, said main piston being longitudinally guided in said hollow cylinder, said hollow cylinder forming said striker, a crank transmission for driving said main piston towards and backwards from said tool and wherein a main air chamber is formed between said transverse wall of the hollow cylinder and the front face of said piston, said air chamber being periodically open to or closed from the atmosphere and, when filled with air, operating as a spring acting on the striker to transmit impact energy thereto, and wherein said striker during a return stroke of said main piston is pulled backwards under underpressure in said main air chamber, said main air chamber being subdivided into the aforementioned two air chambers by said intermediate piston.

5. The hammer drill as defined in claim 1, wherein said wall means is formed with a recess radially extending from said bore, said recess receiving a sealing O-ring.

6. The hammer drill as defined in claim 5, wherein said piston rod has a longitudinal ventilation groove extended via a portion of the entire length of the piston rod.

7. The hammer drill as defined in claim 6, wherein said main piston rod has an outer end, and wherein a limiting stop is arranged on said outer end for limiting the axial movement of said intermediate piston.

8. The hammer drill as defined in claim 7, further including a damping means inserted between said limiting stop and said main piston.

9. The hammer drill as defined in claim 8, wherein said damping means includes at least one rubber ring.

10. The hammer drill as defined in claim 4, wherein said piston rod has an outer end; and further including a limiting stop arranged on said outer end for limiting the axial movement of said intermediate piston and a compression spring arranged between said main piston and said intermediate piston, said spring tending to constantly maintain said intermediate piston in such a position relative to said main piston that said limiting stop is in an end position relative to said main piston.

11. The hammer drill as defined in claim 10, wherein said intermediate piston has a sealing ring mounted thereon.

12. The hammer drill as defined in claim 1, said main piston being hollow and having a bottom, which forms said wall means, and a cylindrical inner space in which said striker is guided, said striking mechanism further including an elastic air-filled spring means positioned in said inner space between said bottom and said striker, said two air chambers being formed in said cylindrical inner space, said spring means dividing said inner space into said two air chambers.

13. The hammer drill as defined in claim 12, wherein said elastic air-filled spring means include a hollow body enclosing one of said two air chambers.

14. The hammer drill as defined in claim 13, wherein said hollow body is a ball made of rubber.

* * * * *